US008499695B1

(12) United States Patent
Petkov

(10) Patent No.: US 8,499,695 B1
(45) Date of Patent: Aug. 6, 2013

(54) RAILROAD RAIL RETAINING CLIP STAGING AND REMOVAL APPARATUS AND METHOD

(76) Inventor: Ilia Petkov, Colorado Springs, CO (US)

( * ) Notice: Subject to any disclaimer, the term of this patent is extended or adjusted under 35 U.S.C. 154(b) by 707 days.

(21) Appl. No.: 12/009,525

(22) Filed: Jan. 22, 2008

Related U.S. Application Data

(60) Provisional application No. 60/901,546, filed on Feb. 16, 2007, provisional application No. 60/993,608, filed on Sep. 14, 2007.

(51) Int. Cl.
*E01B 29/24* (2006.01)

(52) U.S. Cl.
USPC ..... 104/17.2

(58) Field of Classification Search
USPC ..... 104/2, 17.1, 17.2
See application file for complete search history.

(56) References Cited

U.S. PATENT DOCUMENTS 4,494,463 A * 1/1985 Young et al. ..... 104/17.2
5,839,377 A * 11/1998 Brenny et al. ..... 104/17.2
6,138,573 A * 10/2000 Brenny et al. ..... 104/17.2
2003/0150350 A1 * 8/2003 Wilson ..... 104/17.2

* cited by examiner

*Primary Examiner* — R. J. McCarry, Jr.
(74) *Attorney, Agent, or Firm* — G. F. Gallinger

(57) ABSTRACT

A rail-tie connecting clip engagement/disengagement apparatus for slidably attaching opposite bottom portions of a rail to a tie thereunder with clips each having an outer portion having opposite lateral openings; wherein a first rail side of said apparatus, used to engage/disengage one bottom side of the rail to the tie with one clip, comprises: a) a pair of similar opposite lateral arms, each having an inner hooked end portion to engage one of the lateral openings, a central pivot portion, and an outer end portion carrying one of a cam and a cam follower; b) the other of the cam and the cam follower, being an actuating arm, motivated by the outer end portion thereof to cause appropriate engagement/disengagement of the hooked end portions in the opposite lateral openings of the clip; c) bias means to maintain the cam in contact with the cam follower; and, d) lateral arm longitudinal movement means to jointly move the arms to and away from the rail, to thereby push/pull the clip when engaged by the hooked end portion of the arms. After the hooked end portions of the pair of arms jointly engage the U shaped clip, the clip may be alternatively pushed over engaging the bottom portion of the rail, or alternatively pulled therefrom, disengaging the bottom portion of the rail from the tie.

20 Claims, 9 Drawing Sheets

RAILROAD RAIL RETAINING CLIP STAGING AND REMOVAL APPARATUS AND METHOD

PRIOR APPLICATION

This application is a continuation in part of information disclosed in provisional application 60/901,546, filed Feb. 16, 2007 and also in provisional application 60/993,608, filed Sep. 14, 2007.

FIELD OF THE INVENTION

This invention relates to the removable attachment of railroad rails to rail ties. More particularly this invention relates to an apparatus with which the retaining clips used to removably attach the railroad rails to the rail ties can be conveniently and safely installed or removed.

BACKGROUND OF THE INVENTION

Railroad rails are attached to each rail tie with retaining clips. These retaining clips are difficult to install. They must be squarely hammered with a substantial impact, otherwise they spring back out of position, flying into the air. If the clips are not hit struck with sufficient force and accuracy their subsequent random trajectory is a real danger to installation personnel. A new style of railroad rail-retaining clip, the SAFELOK III, a TM registered to the PandrolUSA, has been produced to better attach rails to the rail ties. Unlike the preceding rail-retaining clip, the SAFELOK I, a TM registered to PandrolUSA, the SAFELOK III TM need not be laterally squeezed before they are removed. None the less, these clips are still sufficiently difficult and dangerous to remove, either for rail replacement or track maintenance, that standard removal practice entails cutting the clips with a torch. Cutting the clips with a torch is relatively time consuming operation. After being cut, the cut clips are unusable and must be replaced.

What is needed is a clip removal tool which can both safely and efficiently, either install and/or remove the rail-tie attachment clips. Potential injury to railroad personnel, time consumption, the arduous task of accurately and powerfully swinging a heavy hammer, as well as clip destruction would all thereby be eliminated.

OBJECTS OF THE INVENTION

It is an object of this invention to disclose a safe and efficient tool for both the removal and installation of rail-tie attachment clips. It is an object of this invention to disclose a tool which eliminates the need to accurately and powerfully strike a rail-tie retention clip with a heavy hammer. It is yet a further object of this invention to disclose a tool which saves substantial labor, not only when attaching the rail to the ties, but also when repairing and maintaining the track, when it is necessary to remove and replace the rail-tie attachment clips. It is yet a further object of this invention to disclose a tool which allows quick and convenient removal as well as reuse of engaged rail-tie attachment clips. It is yet a further object of this invention to disclose a tool which can remove and install not only the Safelock III rail-tie attachment clips, but additionally the Safelock I rail-tie attachment clip. Safelock III rail-tie attachment clips are replacing Safelock I attachment clips; however, each style of clips requires a mating tie, so Safelock I clips will be in use almost indefinitely, until all ties on an existing track are replaced.

One aspect of this invention provides for a rail-tie connecting clip engagement/disengagement apparatus for slidably attaching opposite bottom portions of a rail to a tie thereunder with clips; each clip slidably positioned within a tie clip pocket, which while said clip is therein, slidably maintains the clip adjacent to the tie while allowing the clip to slide away from, or towards and over the rail for engagement thereof; and, each clip having a generally U shaped cross section—having a lower portion slidably positioned in the pocket, an upper portion for slidable engagement over the bottom portion of the rail, and an outer portion which attaches and biases the upper and lower portions together, and which has opposite lateral openings; wherein a first rail side of said apparatus, used to engage/disengage one bottom side of the rail to the tie with one clip, comprises: a) a pair of similar opposite lateral arms, each arm having an inner hooked end portion to engage one of the lateral openings in the outer portion of the clip, a central pivot portion, and an outer end portion carrying one of a cam and a cam follower; b) the other of the cam and the cam follower being an actuating arm, motivated along the outer end portion thereof to thereby cause appropriate engagement/disengagement of the hooked end portions in the opposite lateral openings of the clip; c) bias means to maintain the cam in contact with the cam follower; and, d) lateral arm longitudinal movement means to jointly move the arms to and away from the rail, to thereby push/pull the clip when engaged by the hooked end portion of the arms. After the hooked end portions of the pair of arms jointly engage the U shaped clip, the clip may be alternatively pushed over, engaging the bottom portion of the rail, or alternatively; pulled therefrom, disengaging the bottom portion of the rail from the tie.

In a preferred aspect of this invention the above apparatus further comprises a frame having opposite upright sides, each side having a longitudinal slot therein to receive and guide one of the opposite arms, said opposite arms generally having a frame reception portion of uniform thickness, said frame also positioning and carrying the lateral arm longitudinal movement means. An inner side portion of the outer end portion of the lateral arms is contoured to comprise a cam, the cam follower comprises a lower portion of an actuating arm which similarly pivots each of the lateral arms to thereby grip and hold the clip, and the outer end portion of the lateral arms are biased together with a spring.

Various other objects, advantages and features of this invention will become apparent to those skilled in the art from the following description in conjunction with the accompanying drawings.

FIGURES OF THE INVENTION

Figure 3:
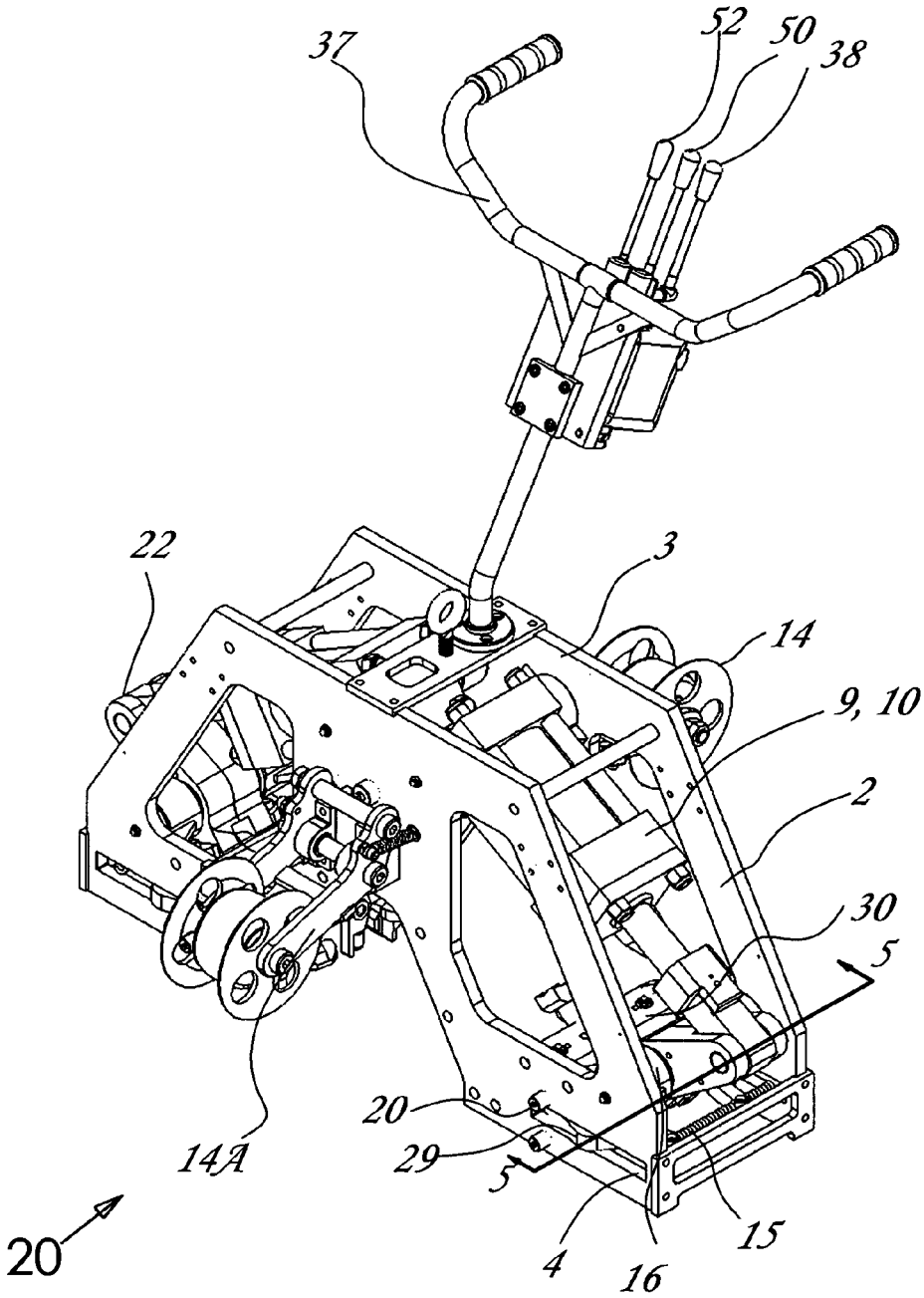
FIG. 3 is a perspective view of a rail retaining clip staging and removal apparatus.

FIGS. 5A-E are perspective views of a first side of the apparatus, used to engage/disengage one bottom side of the rail to the tie with one clip, as viewed along line 5-5 in FIG. 3. FIGS. 5A-E show movement of the first side of the apparatus, beginning with an initial pre-clip grasping position, continuing through clip pulling, and ending with clip release.

Figure 5A:
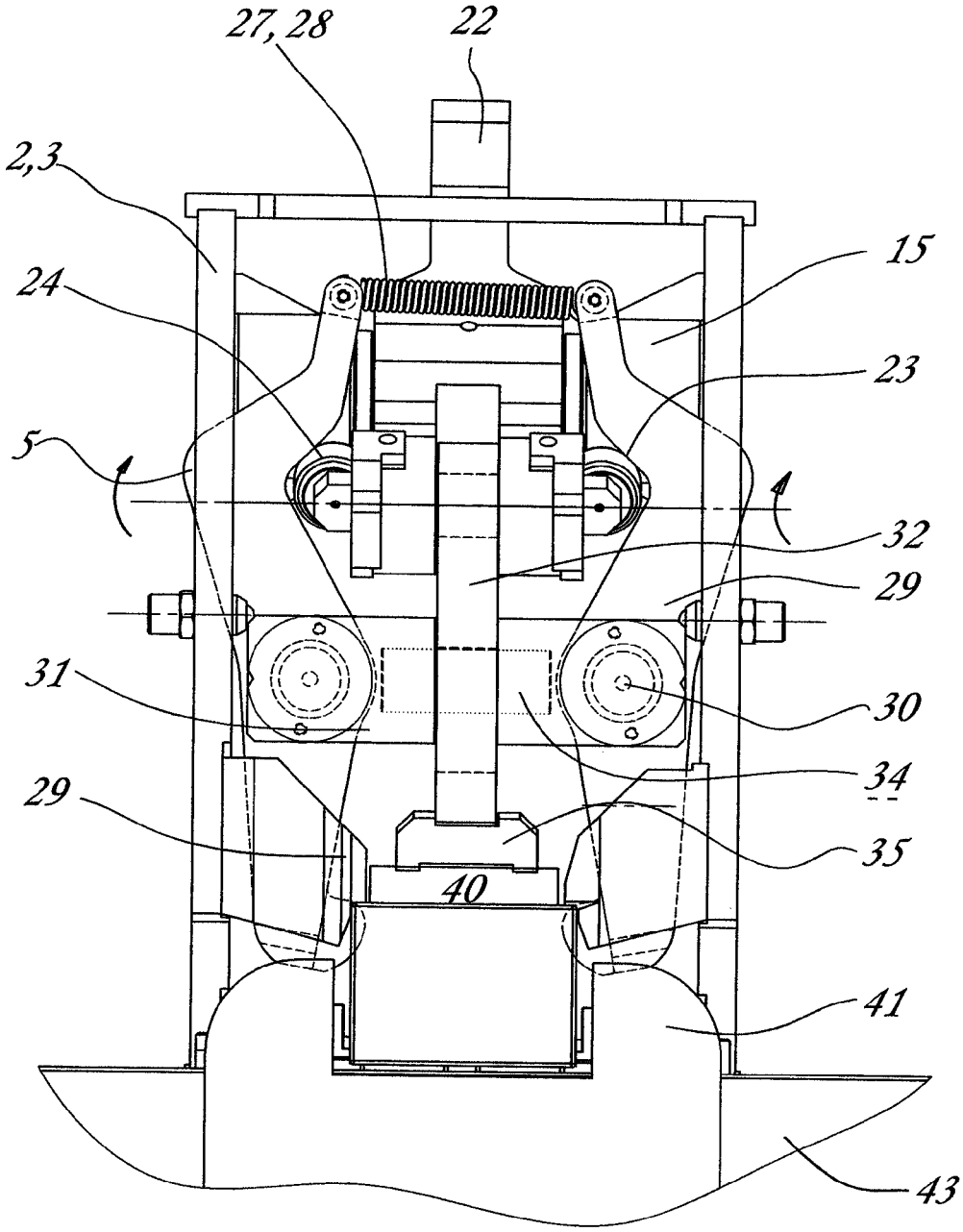
Figure 5B:
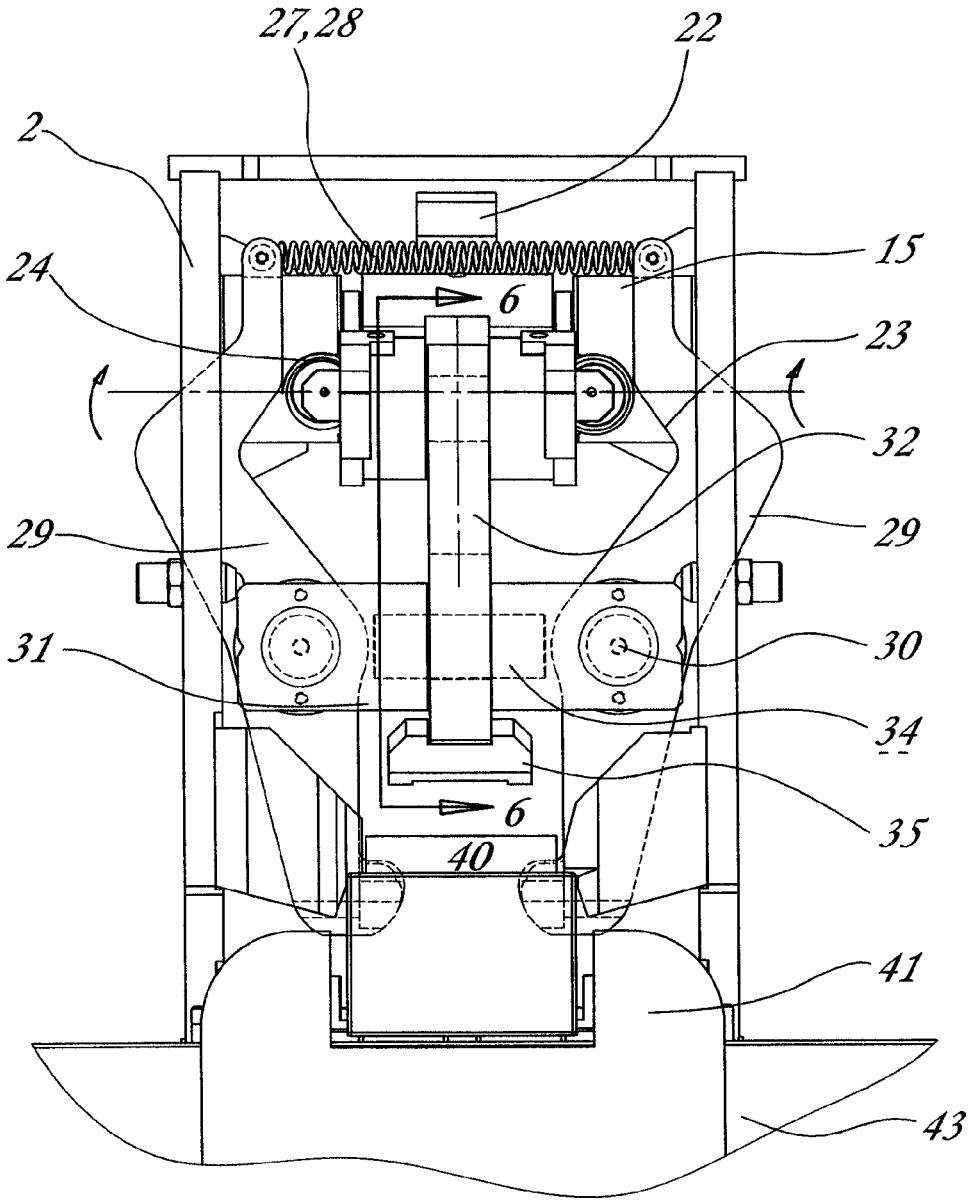
Figure 6:
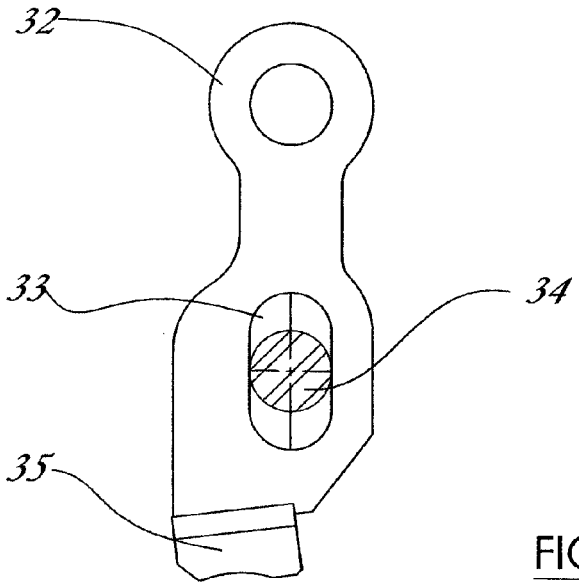

FIG. 6 is a cross sectional view of the gripping link as viewed along line 6-6 in FIG. 5B.

Figure 7:
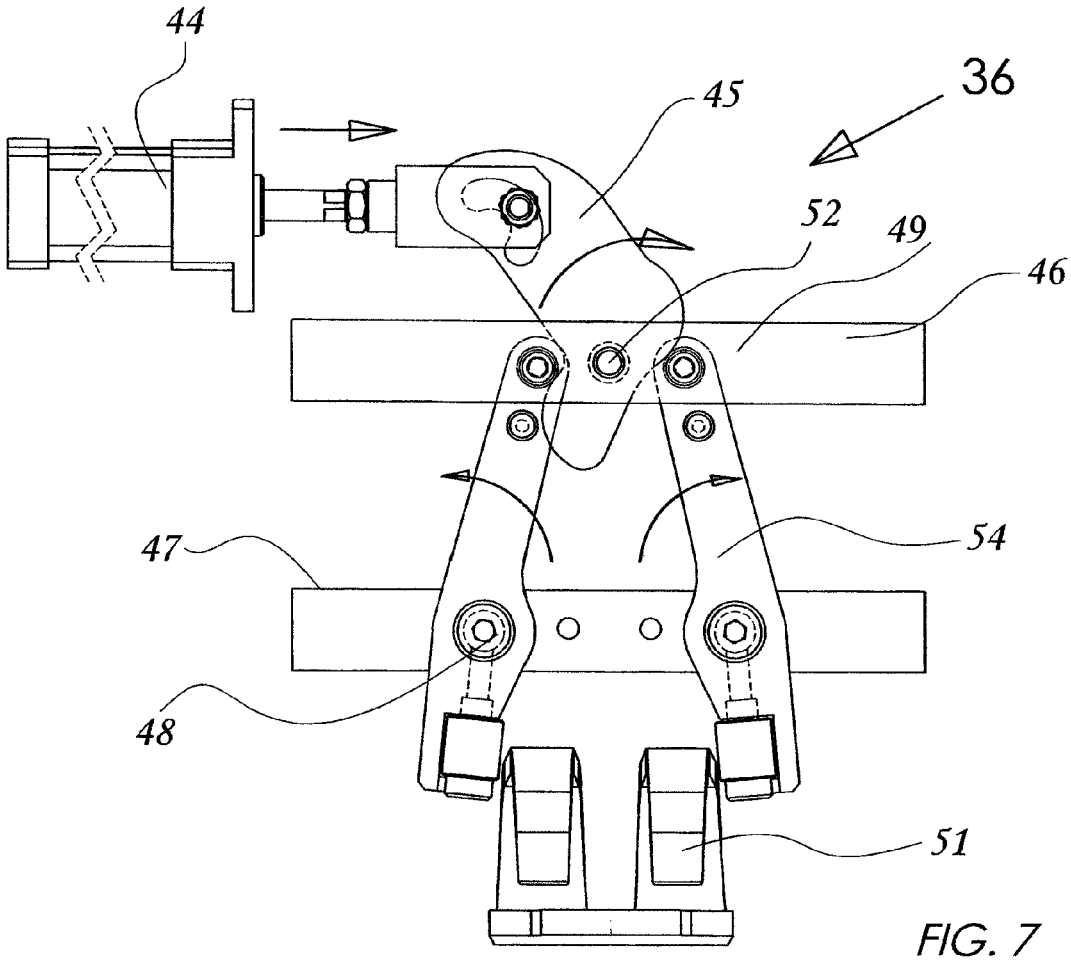

FIG. 7 is a perspective view of the clip squeeze mechanism used to laterally squeeze the inner upper portion of an older style clip, such squeezing being necessary prior to pushing the clip for engagement or pulling the clip for removal.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 1:
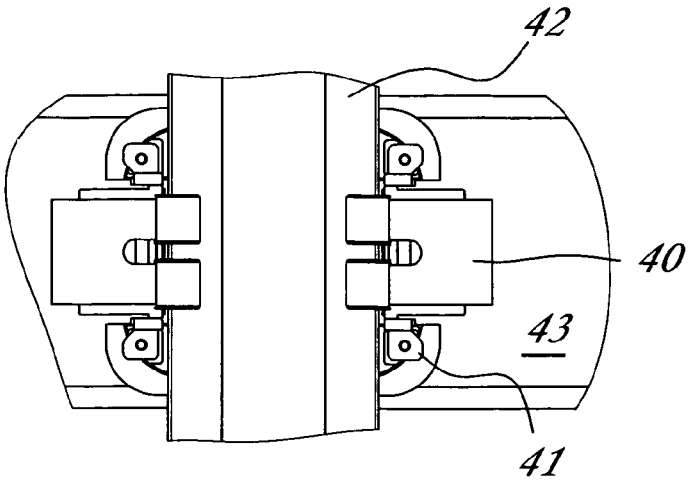
FIG. 1 is a plan view of an end portion of tie carrying a rail. The clips shown are in an engaged position, securing opposite bottom portions of the rail to the tie.
Figure 2:
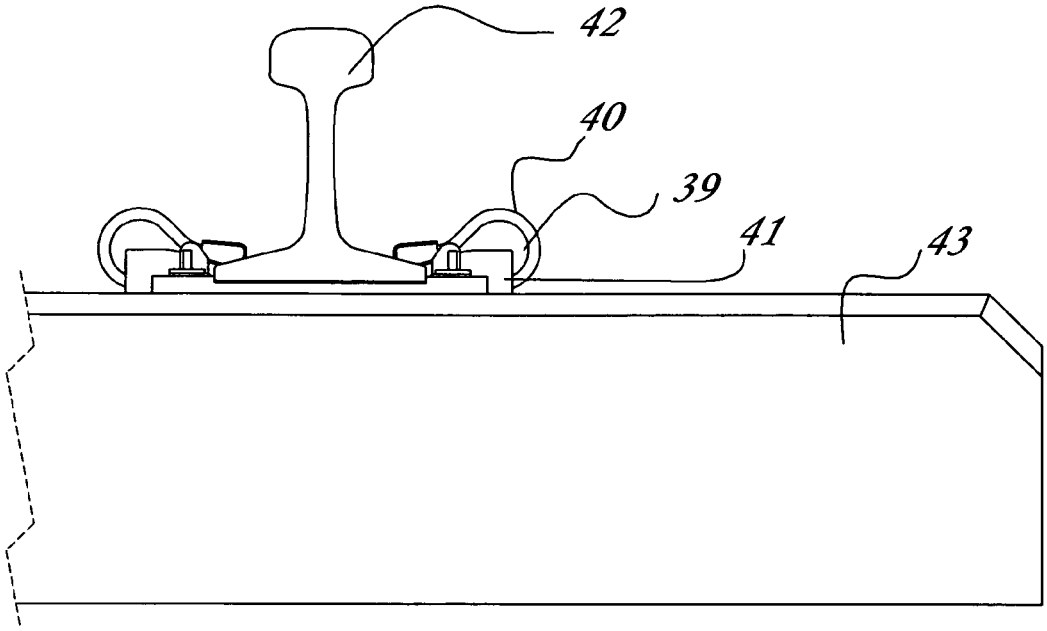
FIG. 2 is an elevational view of the tie, rail and clips shown in FIG. 1. The clips are shown pulled apart in an unengaged position.

Turning now to the drawings and more particularly to FIG. 1 we have a plan view of an end portion of a tie 43 carrying a rail 42. The clips 40 shown are in an engaged position, securing opposite bottom portions of the rail 42 to the tie 43. FIG. 2 is an elevational view of the tie 43, rail 42 and clips 40 shown in FIG. 1. The clips 40 shown are pulled apart in an unengaged position. The clips 40 slidably attach opposite bottom portions of the rail 42 to the tie 43 thereunder. Each clip 40 is slidably positioned within a tie clip pocket 41, which while said clip 40 is therein, slidably maintains the clip 40 adjacent to the tie 43 while allowing the clip 40 to slide away from, or towards and over the rail 42 for engagement thereof. Each clip 40 has a generally U shaped cross section—having a lower portion slidably positioned in the pocket 41, an upper portion for slidable engagement over the bottom portion of the rail 42, and an outer portion which attaches and biases the upper and lower portions together, and which has opposite lateral openings 39.

Figure 4:
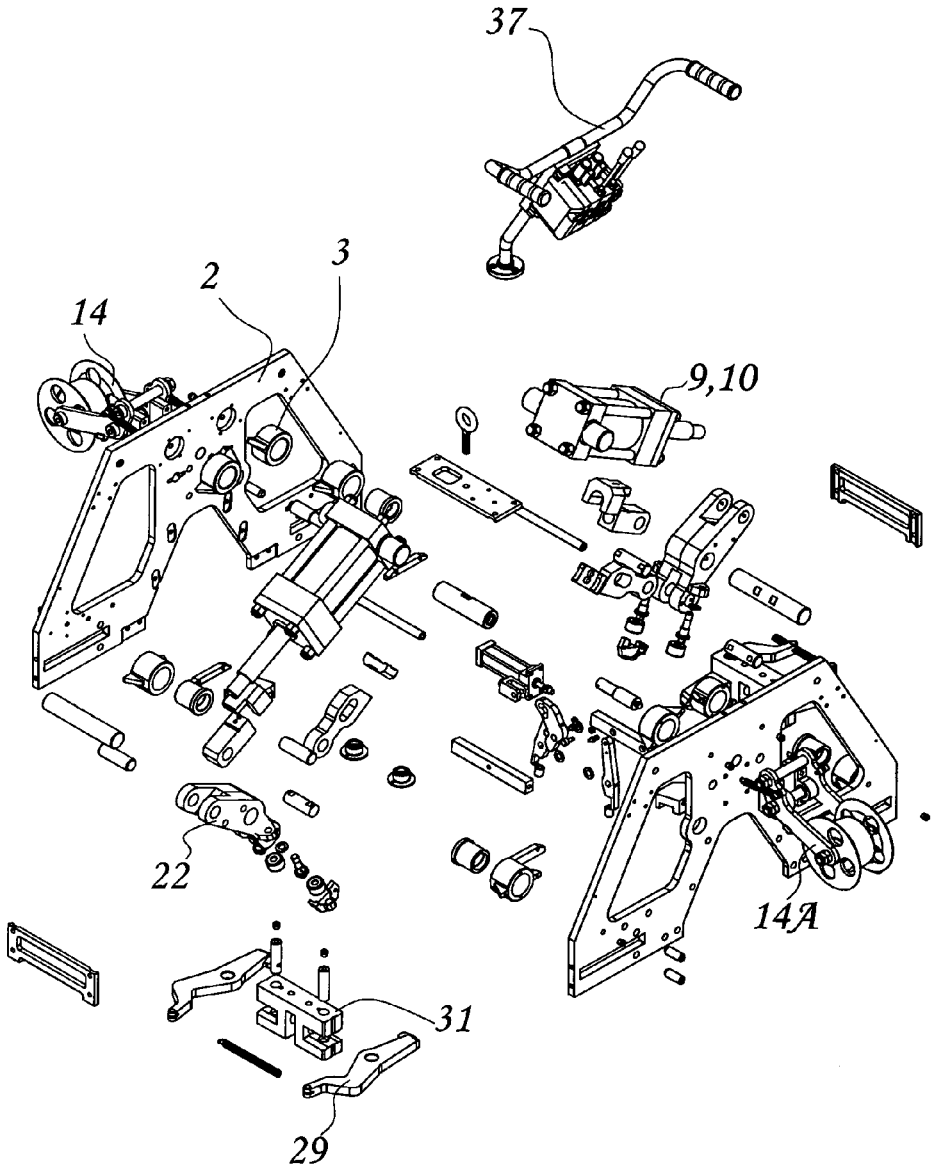
FIG. 4 is an exploded view of the apparatus shown in FIG. 3.
Figure 5C:
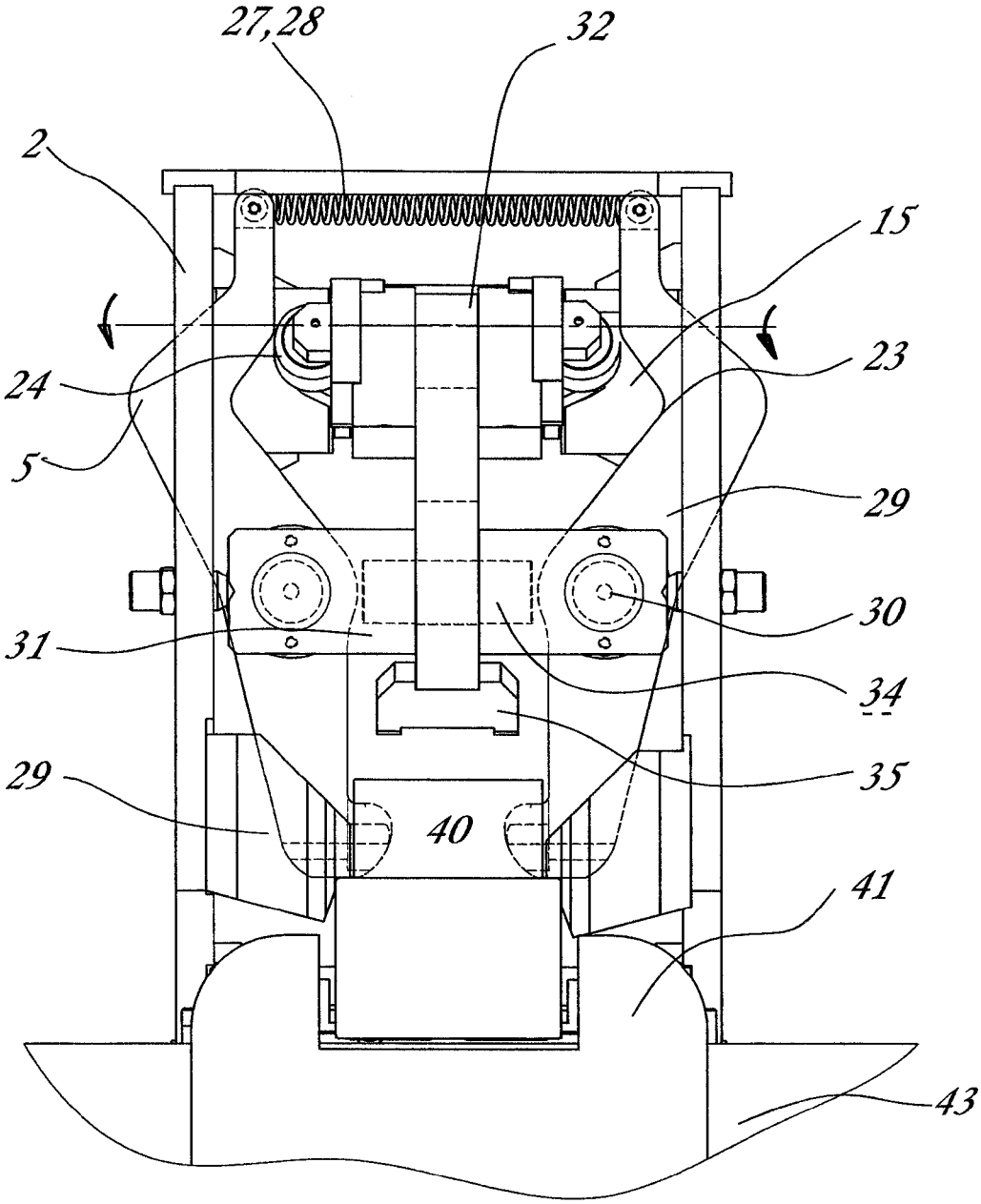
Figure 5D:
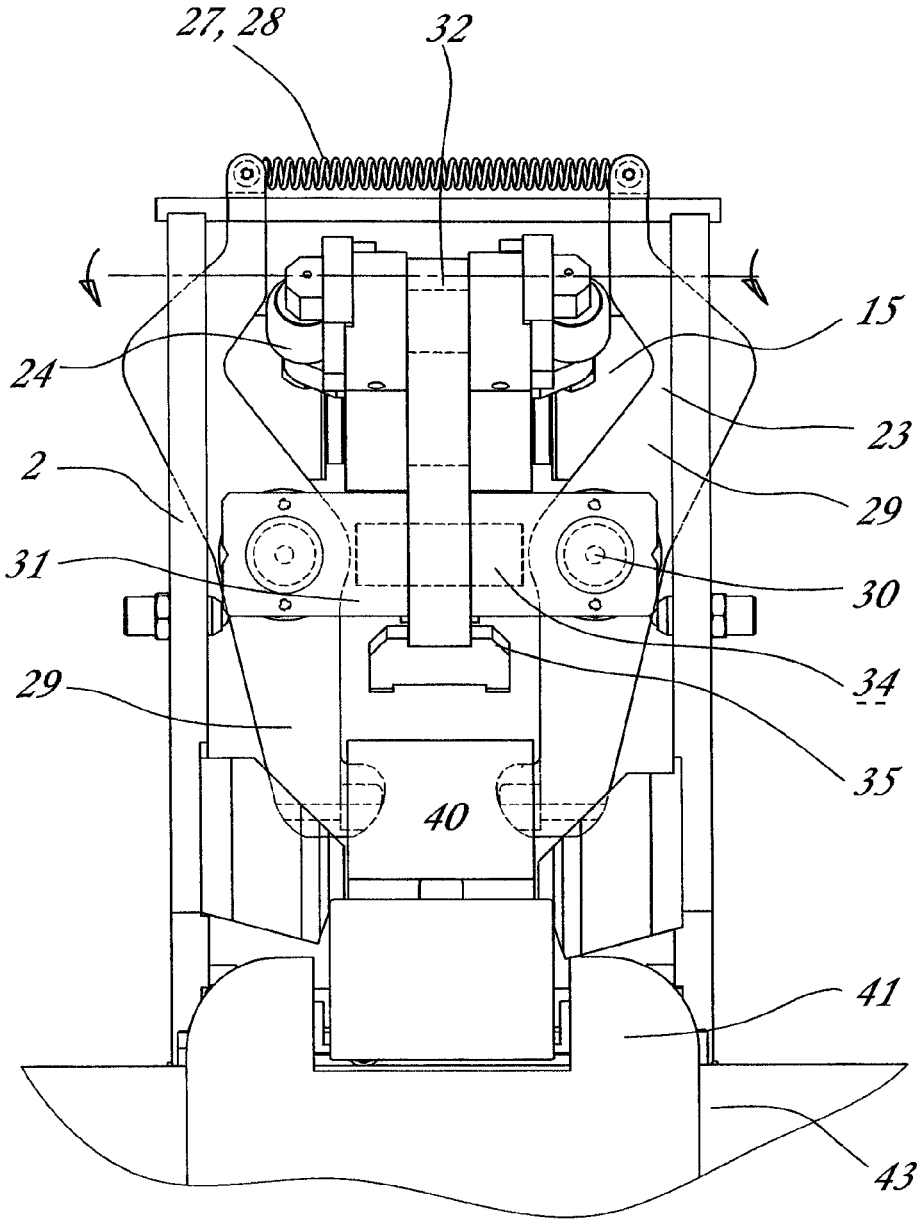
Figure 5E:
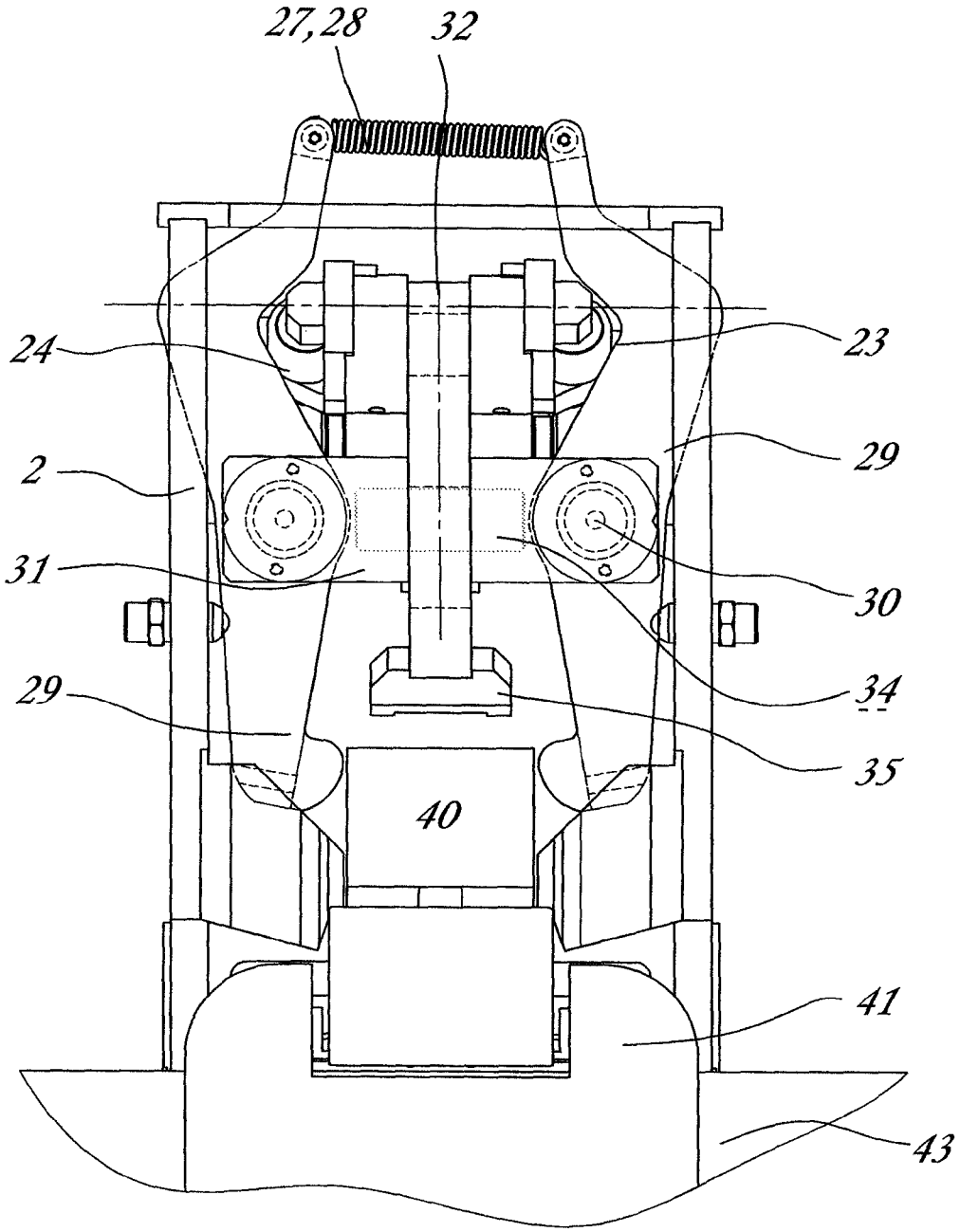

FIG. 3 is a perspective view of a railroad rail retaining clip staging and removal apparatus 20. FIG. 4 is an exploded view of the apparatus 20 shown in FIG. 3. FIGS. 5A-E are perspective views of a first side of the apparatus 20, used to either engage or disengage one bottom side of the rail 42 to the tie with one clip 40. FIGS. 5A-E show movement of the first side of the apparatus 20, beginning with an initial pre-clip grasping position, as shown in FIGS. 5A,5B; continuing through clip pulling, as shown in FIGS. 5C,5D; and ending with clip release, as shown in FIG. 5E. Most generally, a rail-tie connecting clip engagement/disengagement 20 apparatus has a first side, used to engage/disengage one bottom side of the rail 40 to the tie 43 with one clip 40, which comprises: a) a pair of similar opposite lateral arms 29, each arm 29 having an inner hooked end portion to engage one of the lateral openings 39 in the outer portion of the clip 40, a central pivot portion, and an outer end portion carrying one of a cam 23 and a cam follower 24; b) the other of the cam 23 and the cam follower 24 being an actuating arm 22, motivated along the outer end portion thereof to thereby cause appropriate engagement or disengagement of the hooked end portions in the opposite lateral openings of the clip 40; c) bias means 27 to maintain the cam 23 in contact with the cam follower 24; and, d) lateral arm longitudinal movement means 9 to jointly move the arms 29 to and away from the rail 42, to thereby push/pull the clip 40 when engaged by the hooked end portion of the arms 29. After the hooked end portions of the pair of arms 29 jointly engage the U shaped clip 40, the clip 40 may be alternatively pushed over engaging the bottom portion of the rail 42, or alternatively pulled therefrom, disengaging the bottom portion of the rail 42 from the tie 43.

In the most preferred embodiment of the invention, the apparatus 20 further comprises a frame 2 having opposite upright sides 3, each side 3 having a longitudinal slot 4 therein to receive and guide one of the opposite arms 29, said opposite arms 29 generally having a frame reception portion 5 of uniform thickness, said frame 2 also positioning and carrying the lateral arm longitudinal movement means 9. Also in the most preferred embodiment of the invention, an inner side portion of the outer end portion of the lateral arms 29 is contoured to comprise a cam 23, wherein the cam follower 24 comprises a lower portion of an actuating arm 22 which similarly pivots each of the lateral arms 29 to thereby grip and hold the clip 40, and wherein the outer end portion of the lateral arms 29 is biased together with a spring 28.

Most preferably a gripper frame 31 positioned between, and having opposite end portions pivoted to the central pivot 30 portion of the lateral arms 29, and wherein the lateral arm 29 longitudinal movement means 9 moves the gripper frame 31 to jointly move the lateral arms 29. In the most preferred embodiment of the invention the actuating arm 22 appropriately motivates not only the cam 23, but additionally the gripper frame 31 through a gripper link 32 having one end portion linked to the lower end portion of the actuating arm 22 and the other end portion linked to a central portion of the gripper frame 31. In the most preferred embodiment of the invention the actuating arm 22 is centrally pivoted to the frame 2 on pivot supports 15 and wherein an outer end of the actuating arm is motivated by a hydraulic cylinder 10 pivotably connected thereto.

FIG. 6 is a cross sectional view of the gripper link 32 as viewed along line 6-6 in FIG. 5B. If the one actuating end portion of the gripper link 32 comprises an elongate opening 33 then full engagement of the lateral arms 29 with the clip 40 is facilitated before the gripper link 32 longitudinally pulls the clip 40. (see gripper link 32 in FIGS. 5A,5B) Pushing end portion 35 of the gripping link 32 is used to push on clip 40 when it is being engaged with the bottom portion of the rail 42. A pin 34 is shown in elongate opening 33 of the gripper link 32. Within this specification a pin 34 is defined and intended to include a protrusion, and an elongate opening 33 is defined to include both a slot and an elongate groove which would receive the protrusion.

FIG. 7 is a perspective view of the clip squeeze mechanism 36 used to laterally squeeze the inner upper portion of an older style clip 51. (Please note that the older style clip 51 is generally known as a SAFELOK I, a registered TM of PandrolUSA. Also note that the clips 40, discussed above, are generally known as SAFELOK III, also a registered TM of the PandrolUSA.) Such squeezing is necessary prior to pulling the older style clip 51 for removal. The clip squeeze mechanism 36 comprises: i) a third hydraulic lever to control the squeeze mechanism; ii) cam support member 46 extending across and between opposite upright sides 3 of the frame 2; iii) a cam 45 pivoted to a central portion of the cam support member 45; iv) a cam actuating means 44 coupled to an upper portion of the cam 45; and, v) two cam followers 54 each having an upper end portion motivated by the cam 45, a central pivoted portion, and a lower clip squeezing end portion; so that when the cam 45 rotates the lower clip squeezing end portion of the two cam followers 54 squeeze opposite side portions of the old style clip 51. In the most preferred embodiment the squeeze mechanism 36 further comprises a pivot support member 47 has centrally positioned spaced pivots 48 therealong; said cam followers 47 are separately pivoted to the spaced pivots 48; and when the upper end portions of the cam followers 54 are moved apart by the cam 45, then the lower end portions thereof move together, squeezing the opposite side portions of the clip old style clip 51.

Operation of the Apparatus

A method of installing/disengaging the rail-tie retaining clip 40 most generally described above comprises the steps of: using the hooked end portions of the pair of arms 29 to jointly engage the U shaped clip; and, pulling the clip 40 from the rail 43 to thereby disengaging the rail 42 from the tie; or alternatively, pushing the clip 40 over and engaging the bottom portion of the rail 42 to thereby securing the rail 42 to the tie 43.

When the frame 2 of the apparatus 20 extends over and above the rail 42, and further comprises a second side; and a control handle 37 having two hydraulic control levers a method of removing the two rail-tie retaining clips comprises the steps of: i) moving one of the hydraulic control levers 38 in one direction to lift the apparatus 20; ii) using the control handle 37 to roll the apparatus 20 along the rail 42 so that the apparatus 20 is centered above a tie 43 along the rail 42; iii) then moving the one hydraulic lever 38 the other way to lower the apparatus 20 in the centered position above the tie 43; and finally, iv) moving the other of the hydraulic control levers 50 one way to engage the hooked end portions with the U shaped clips 40 on both sides of the rail 42 and push the both clips 40 over the bottom portions of the rail 42; or alternatively, v) moving the other of the hydraulic control levers 50 the other way to concurrently engage the hooked end portions with the U shaped clips 40 on both sides of the rail 42 and pull both clips 40 from the rail 42, thereby disengaging the rail 42 from the tie 43.

When the apparatus includes a clip squeeze mechanism 36 and third lever 52 to operate the clip squeeze mechanism 36 for removal of the older style of clips 51, a method of removing an older style retaining rail-tie retaining clip 51 comprises the steps of: first moving one of the hydraulic control levers 38 in one direction to lift the apparatus 20 and then using the control handle 37 to roll the apparatus 20 along the rail 42 so that the apparatus 20 is centered above a tie 43 along the rail 42; then moving the one hydraulic lever 38 the other way to lower the apparatus 20 in the centered position above the tie 43; moving the third hydraulic lever 52 to initially squeeze the top outside portion of the clips 51; and, then moving the other of the hydraulic control levers 50 the other way to engage the hooked end portions with the U shaped clips 51 on both sides of the rail 42 and, also pull both clips 51 from the rail 42, thereby disengaging the rail 42 from the tie 43.

While the invention has been described with preferred specific embodiments thereof, it will be understood that this description is intended to illustrate and not to limit the scope of the invention, which is defined by the following claims.

I claim:

1. A rail-tie connecting clip engagement/disengagement apparatus for slidably attaching opposite bottom portions of a rail to a tie thereunder with clips;

each clip slidably positioned within a tie clip pocket, which while said clip is therein, slidably maintains the clip adjacent to the tie while allowing the clip to slide away from, or towards and over the rail for engagement thereof; and, each clip having a generally U shaped cross section—having a lower portion slidably positioned in the pocket, an upper portion for slidable engagement over the bottom portion of the rail, and an outer portion which attaches and biases the upper and lower portions together, and which has opposite lateral openings;

wherein a first rail side of said apparatus, used to engage/disengage one bottom side of the rail to the tie with one clip, comprises:

a) a pair of similar opposite lateral arms, each arm having an inner hooked end portion to engage one of the lateral openings in the outer portion of the clip, a central pivot portion, and an upper end portion carrying one of a cam and a cam follower;

b) the other of the cam and the cam follower being an actuating arm, motivated along the outer end portion thereof to thereby cause appropriate engagement/disengagement of the pivoted hooked end portions of the lateral arms in the opposite lateral openings of the clip;

c) lateral arm longitudinal movement means to jointly move the arms to and away from the rail, to thereby pull the clip when it is engaged by the hooked end portion of the arms;

d) a gripper frame positioned between, and having opposite end portions pivoted to the central pivot portion of the lateral arms, wherein the lateral arm longitudinal movement means moves the gripper frame to longitudinally move the lateral arms;

e) wherein the actuating arm appropriately motivates not only the lateral movement of the lateral arms, but additionally the gripper frame through a gripper link having an upper end portion linked to the lower end portion of the actuating arm and the other lower end portion linked to a central portion of the gripper frame, said gripper link having a longitudinal opening therein which enables initial lateral movement of the lateral arms without moving the gripper frame, and subsequent movement, when the actuating arm is at the end of the slot, to motivate only the gripper frame, said gripper link also having a lower pushing end portion;

f) so that when the actuating arm moves up, first the hooked end portions of the pair of arms jointly engage the U shaped clip, and then, as the upward movement continues, when the movement of the actuating arm within the longitudinal opening in the gripper link comes to an end, the clip is pulled, thereby disengaging the bottom portion of the rail from the tie; and alternatively, g) when the actuating arm moves down, the upper portion of the lateral arms move inwardly causing the hooked end portions to move outwardly, releasing the rail clip, and then, as the downward movement continues, the lower pushing end portion of the gripper link pushes on the rail tie clip thereby engaging the bottom portion of the rail from the tie;

thereby enabling a single hydraulic cylinder to bi-directionally move the actuating arm which in turn fully operates the rail-tie connecting clip engagement/disengagement apparatus, thereby greatly simplifying a previously sequential operation which required multiple controls to be sequentially manipulated by an operator.

2. A rail-tie connecting clip engagement/disengagement apparatus as in claim 1 wherein an edge portion of the actuating arm comprises a cam and wherein the apparatus further comprises bias means to maintain the cam in contact with the cam follower, and wherein the longitudinal opening in the gripper link comprises a pin operatively connected to the actuating arm.

3. An apparatus as in claim 2 further comprising a frame having opposite upright sides, each side having a longitudinal slot therein to receive and guide one of the opposite arms, said opposite arms generally having a frame reception portion of uniform thickness, said frame also positioning and carrying the lateral arm longitudinal movement means.

4. An apparatus as in claim 2 wherein an inner side portion of the outer end portion of the lateral arms is contoured to comprise a cam, wherein the cam follower comprises a lower portion of an actuating arm which similarly pivots each of the lateral arms to thereby grip and hold the clip, and wherein the outer end portion of the lateral arms are biased together with a spring.

5. An apparatus as in claim 4 further comprising a gripper frame positioned between, and having opposite end portions pivoted to the central pivot portion of the lateral arms, and wherein the lateral arm longitudinal movement means moves the gripper frame to longitudinally move the lateral arms.

6. An apparatus as in claim 5 wherein the actuating arm appropriately motivates not only the cam, but additionally the gripper frame through a gripper operating link having one end portion linked to the lower end portion of the actuating arm and the other end portion linked to a central portion of the gripper frame.

7. An apparatus as in claim 4 wherein the one actuating end portion of the gripper link comprises an elongate opening to facilitate full engagement of the lateral arms with the clip, before the gripper link longitudinally pulls the clip.

8. An apparatus as in claim in claim 4 wherein the actuating arm is centrally pivoted to the frame and wherein an outer end of the actuating arm is motivated by a hydraulic cylinder pivotably connected thereto.

9. An apparatus as in claim 8 wherein the frame extends over and above the rail, and further comprises a second side, used to concurrently engage/disengage the other bottom side of the rail to the tie with a second clip; so after the apparatus is centered above a tie along the rail, the rail-tie attachment clips on opposite bottom sides of the rail are concurrently engaged/disengaged.

10. An apparatus as in claim 9 further comprising two wheel assemblies, each carried on a lower end portion of a lifting arm, each lifting arm having an upper portion pivoted to a central portion of an opposite side of the frame, so that when the lifting arms are downwardly rotated the frame is rollingly carried on the wheels along the rail.

11. An apparatus as in claim 10 further comprising a control handle extending upwardly from a central portion of the frame above the rail, for convenient movement and positioning of the apparatus along the rail, said handle carrying and further comprising two hydraulic control levers, one lever used to alternatively raise and lower the apparatus on the rail, and the other used to engage/pull/then release clips on opposite sides of the rail, and alternatively to engage/push/then release clips thereby attaching the rail to the tie.

12. An apparatus as in claim 11 further comprising a third hydraulic control lever which controls a clip squeeze mechanism to laterally squeeze the inner upper portion of an older style clip, such squeezing being necessary prior to pulling an old style clip for removal, said squeeze mechanism having: a) cam support member extending across and between opposite upright sides of the frame; b) a cam pivoted to a central portion of the cam support member; c) a cam actuating means coupled to an upper portion of the cam; and, c) two cam followers each having an upper end portion motivated by the cam, a central pivoted portion, and a lower clip squeezing end portion; so that when the cam rotates the lower clip squeezing end portion of the two cam followers squeeze opposite side portions of the clip.

13. An apparatus as in claim 12 wherein the mechanism further comprises a pivot support member having centrally positioned spaced pivots therealong; said cam followers separately pivoted to the spaced pivots; and wherein when the upper end portions of the cam followers are moved apart by the cam, then the lower end portions thereof move together, squeezing the opposite side portions of the clip.

14. A method of removing an older style retaining rail-tie retaining clip comprises the steps of:

a) providing an apparatus as specified in claim 12;
b) first moving one of the hydraulic control levers in one direction to lift the apparatus and then using the control handle to roll the apparatus along the rail so that the apparatus is centered above a tie along the rail;
c) then moving the one hydraulic lever the other way to lower the apparatus in the centered position above the tie;
d) moving the third hydraulic lever to initially squeeze the top outside portion of the clips; and,
e) then moving the other of the hydraulic control levers the other way to engage the hooked end portions with the U shaped clips on both sides of the rail and also pull both clips from the rail, thereby disengaging the rail from the tie.

15. A method of removing a rail-tie retaining clip comprises the steps of:

a) providing an apparatus as specified in claim 11;
b) first moving one of the hydraulic control levers in one direction to lift the apparatus;
c) using the control handle to roll the apparatus along the rail so that the apparatus is centered above a tie along the rail;
d) then moving the one hydraulic lever the other way to lower the apparatus the centered position above the tie;
e) moving the other of the hydraulic control levers one way to push the both clips over the bottom portions of the rail; or alternatively,
f) moving the other of the hydraulic control levers the other way to concurrently engage the hooked end portions with the U shaped clips on both sides of the rail and pull both clips from the rail, thereby disengaging the rail from the tie.

16. A method of installing a rail-tie retaining clip comprises the steps of:

a) providing an apparatus as specified in claim 11;
b) first moving one of the hydraulic control levers in one direction to lift the apparatus;
c) using the control handle to roll the apparatus along the rail so that the apparatus is centered above a tie along the rail;
d) then moving the one hydraulic lever the other way to lower the apparatus in the centered position above the tie; and,
e) moving the other of the hydraulic control levers one way to push the both clips over the bottom portions of the rail;

thereby securing the rail to the tie.

17. A method of installing a rail-tie retaining clip comprises the steps of:

a) providing an apparatus as specified in claim 9;
b) centering the apparatus above a tie along the rail;
c) pushing the clip over and engaging the bottom portion of the rail, thereby securing the rail to the tie.

18. A method of removing a rail-tie retaining clip comprises the steps of:

a) providing an apparatus as specified in claim 9;
b) centering the apparatus above a tie along the rail;
c) then concurrently using the hooked end portions of the pair of arms to jointly engage the U shaped clip; and finally,
d) pulling the clip from the rail, thereby disengaging the rail from the tie.

19. A method of installing a rail-tie retaining clip comprises the steps of:

a) providing an apparatus as specified in claim 2;

b) elongating the single hydraulic cylinder to thereby causing the actuating arm to move up, so that the hooked end portions of the pair of arms to jointly first disengage the U shaped clip, and then, as the upward movement continues, and when the movement of the actuating arm within the longitudinal opening in the gripper arm link comes to an end, the gripper link makes contact with the clip and the clip is pushed thereby engaging the bottom portion of the rail and the tie.

20. A method of disengaging a rail-tie retaining clip comprises the steps of:

a) providing an apparatus as specified in claim 2;

b) shortening the single hydraulic cylinder to thereby causing the actuating arm to move down, so that the upper portion of the gripper arms move outwardly causing the hooked end portions to move inwardly, grasping the rail clip, and when the movement of the actuating arm within the longitudinal opening comes to an end, the gripper frame and lateral arms are pulled, thereby removing the rail tie clip thus disengaging the bottom portion of the rail from the tie.

* * * * *